US005289983A

United States Patent [19]

Ueda et al.

[11] Patent Number: 5,289,983

[45] Date of Patent: Mar. 1, 1994

[54] PRODUCTION CONTROL SYSTEM IN SPINNING MILL

[75] Inventors: Yutaka Ueda, Nara; Keizo Ohori, Kyoto; Tetsuji Masai, Kusatsu, all of Japan

[73] Assignee: Murata Kikai Kabushiki Kaisha, Kyoto, Japan

[21] Appl. No.: 924,593

[22] Filed: Jul. 22, 1992

Related U.S. Application Data

[63] Continuation of Ser. No. 681,875, Apr. 5, 1991, abandoned.

[30] Foreign Application Priority Data

Apr. 12, 1990 [JP] Japan ..... 2-95201
Jul. 31, 1990 [JP] Japan ..... 2-80559[U]

[51] Int. Cl.[5] ..... B65H 54/02; B65G 47/10

[52] U.S. Cl. ..... 242/35.5 A; 57/264; 57/281; 198/349; 198/350; 209/927

[58] Field of Search ..... 57/264, 265, 281, 90; 242/35.5 A; 209/927, 3.3; 198/349, 349.4, 350

[56] References Cited

U.S. PATENT DOCUMENTS 4,351,494 9/1982 Schippers et al. ..... 57/265 X
4,660,370 4/1987 Matsui et al. ..... 57/264 X
4,691,231 7/1987 Ueda et al. ..... 242/35.5 A
4,718,560 1/1988 Kiriake ..... 209/927 X
4,838,019 6/1989 Ueda ..... 57/264
4,843,808 7/1989 Rüge et al. ..... 57/264
4,854,439 8/1989 Ueda ..... 242/35.5 A
4,940,127 7/1990 Kikuchi et al. ..... 242/35.5 A
4,970,856 11/1990 Taniguchi et al. ..... 57/281
5,003,762 4/1991 Scaglia ..... 57/281
5,033,623 7/1991 Grecksch et al. ..... 242/35.5 A

FOREIGN PATENT DOCUMENTS 3742112 6/1988 Fed. Rep. of Germany ..... 57/281
57-170354 10/1982 Japan .
2171874 7/1987 Japan ..... 209/927

*Primary Examiner*—John M. Jillions
*Assistant Examiner*—Michael R. Mansen
*Attorney, Agent, or Firm*—Spensley Horn Jubas & Lubitz

[57] ABSTRACT

In a spinning mill in which a bobbin from a spinning frame is mounted on a bobbin tray and sent to a winder, a package doffed from the winder is loaded on a hanger and then the package is mounted on a package tray, recording media is provided on the bobbin tray, on the hanger and the package tray, respectively. Frame numbers and spindle numbers which are production origin information of bobbins are written on the recording medium so that the production origin information can be controlled and the records can be grasped.

12 Claims, 9 Drawing Sheets

PRODUCTION CONTROL SYSTEM IN SPINNING MILL

This is a continuation of application Ser. No. 07/681,875, filed on Apr. 5, 1991, now abandoned.

FIELD OF THE INVENTION

The present invention relates to a quality and production control system in a spinning mill.

The present invention further relates to a package carrying apparatus operated when wound packages doffed by an automatic winder are carried to a lifting device, and particularly to a package carrying apparatus which can grasp information such as information by which spindle a wound package was wound.

RELATED ART STATEMENT

Generally, in a spinning mill, raw cotton is received to produce yarns through various steps such as mixing and blowing, combing, drawing, roving, spinning, unwinding, inspection, packaging, shipment from warehouse, etc. Then, the produced yarns are delivered to the post-steps outside the mill, for example, such as weaving, dyeing, etc.

FIG. 12 shows the outline of a system including steps from a spinning frame to a warehouse in a conventional spinning mill.

On the left side of FIG. 12, a so-called spinning winder is constituted in which a plurality of spinning frames 1 and winders 2 are directly connected. Spinning bobbins 3 produced in the spinning frames 1 are simultaneously doffed and stood upright on bobbin trays 4 which can be moved in pitch along the spinning spindles. The bobbin 3 mounted integral with the tray 4 is sent to the winder 2, where the bobbin 3 is rewound on a yarn package 5 having a predetermined shape and an amount of yarn. The package 5 doffed from the winder 2 is supplied by a package carrying system 6 including an overhead conveyor 7, a loading device 8 and an unloading device 9 to an inspection station 10.

In the inspection station 10 for packages, the state of a yarn surface of the package is checked visually by an operator or by an optical inspection device. Defective packages are removed from the carrying line. Acceptable packages are stored in a stocker 14 and subjected to packing 18 and labelling 16, and then introduced into a warehouse 19.

However, in the past, in the case where abnormality with regard to production or quality occurs in the aforesaid inspection station within the spinning mill or in the case where a problem with regard to quality occurs in the post steps such as weaving, dyeing or the like after shipment of products, it was impossible to discriminate by which spinning frame or winder and spindle the products of defective quality were produced. Accordingly, it has been extremely difficult to grasp "When, where and what problem occurred?" in taking measures.

Records of individual products cannot be grasped backing to the spinning frames or winders and spindles as described above for reasons as noted below:

(1) A single spinning frame and winder consists of a plurality of units (spindles). It is unclear to find from which frame the product comes.

(2) There is no means to discriminate to which automatic winder and which spindle a bobbin on which spinning frame and which spindle is supplied.

(3) There is no means to discriminate in which box a wound package on which automatic winder and which spindle is packed.

OBJECT AND SUMMARY OF THE INVENTION

It is an object of the present invention to provide a production control system in a spinning mill in which in the case where a problem with regard to production or quality within a spinning mill occurs or in the case where a problem with regard to quality occurs in the past steps such as weaving, dyeing or the like after shipment of products, the origin of manufacture can be grasped from records thereof and measures can be taken.

A production control system according to the present invention comprises, in a spinning mill in which a bobbin from a spinning frame is mounted on a bobbin tray and sent to a winder, a package doffed from the winder is loaded on a hanger and carried by the hanger after which it is unloaded and mounted on a package tray, which is supplied to an inspection station where acceptable packages are packed in boxes, recording media provided on said bobbin tray, said hanger and said package tray, a write device for recording frame numbers and spindle numbers (production origin information) on the recording medium of the hanger at the time of loading, a read/write device for transferring said recorded information from said recording medium of the hanger to a recording medium of the package tray at the time of unloading, and a visible display means for reading said transferred information from the package tray to apply production origin information to a read package.

Frame numbers and spindle numbers which are production origin information of bobbins are written on the recording medium of the bobbin tray between the spinning frame and the winder for control. Further, frame numbers and spindle numbers which are production origin information of packages are written on the recording medium of the hanger between the loading and unloading of the hanger for control, and they are written on the recording medium of the package tray between the unloading and inspection station for control. Also when a package is removed from the package tray prior to packing, said production origin information is applied to the removed package for control by the visible display means such as labelling. As a simple method of control, winder numbers supplied to packing cases with a plurality of packages packed therein may be visibly displayed.

Accordingly, a flow of products and a flow of information of spinning frames or spindles of winders are synchronized in the step in which bobbins from the spinning frames are rewound on the packages and then enters the warehouse so that detailed information of production, quality and the like can be controlled by a computer and records thereof can be grasped. Even if products of unacceptable quality are discovered from the production origin information visibly displayed, the cause can be cleared up backing to steps, frames and spindles.

DETAILED DESCRIPTION OF PREFERRED EMBODIMENT

Figure 1:
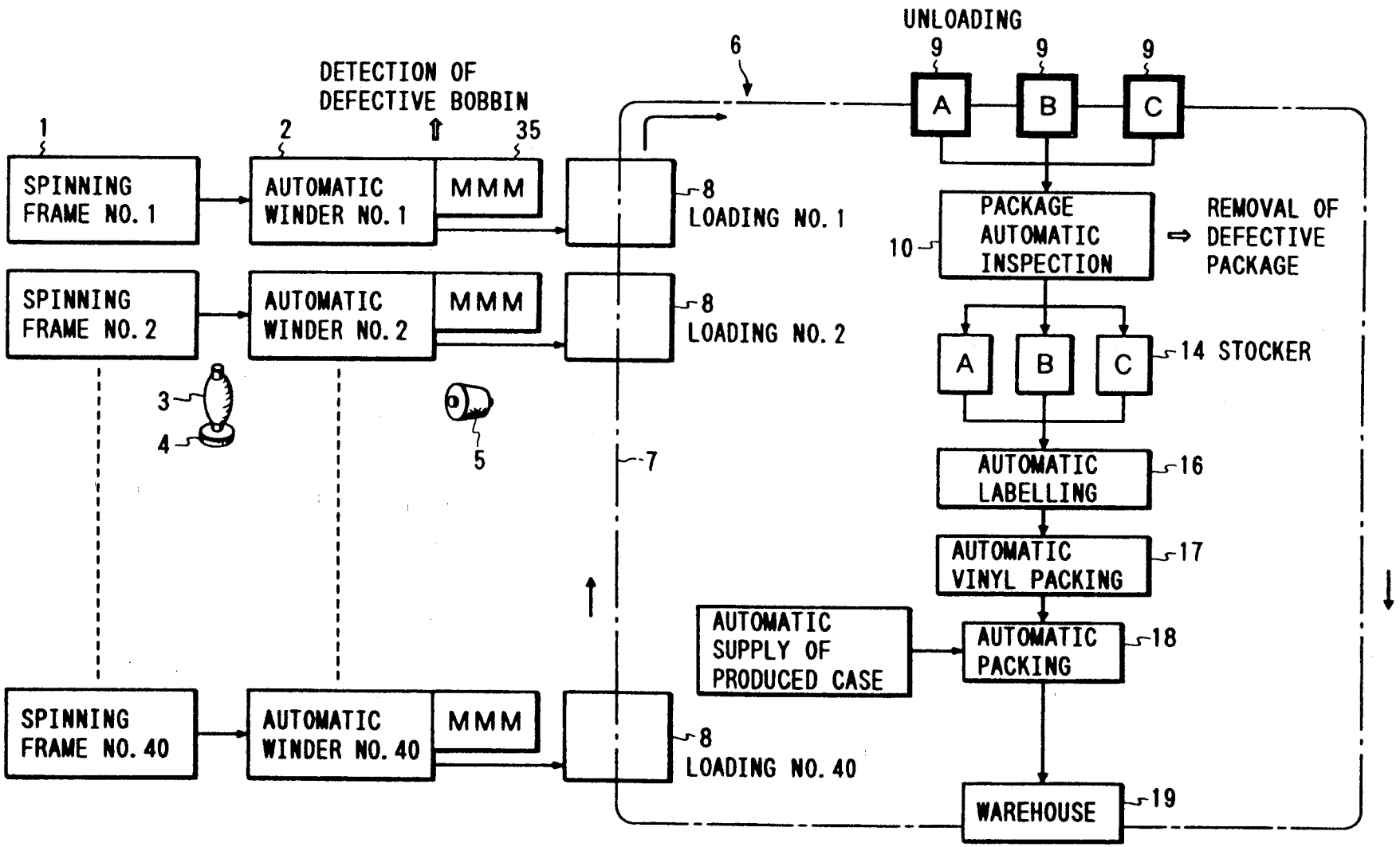
FIG. 1 is a schematic view of a quality and production control system according to an embodiment of the present invention.

The present invention will be described hereinafter by way of embodiments shown in the drawings.

FIG. 1 shows the outline of a system of steps from spinning frames to a warehouse in a spinning mill.

In FIG. 1, reference numeral 1 designates a spinning frame and numeral 2 designates a winder. A plurality (forty in this embodiment) of spinning frames 1 and winders 2 are provided. A set of the spinning frame 1 and the winder 2 are directly connected to each other to constitute a so-called spinning winder 2. Each of the spinning frames 1 and winders 2 comprises a number of units. A constant-length device 35 is provided on each winder 2.

Spinning bobbins 3 produced in the spinning frame 1 are simultaneously doffed and stood upright on trays 4 which can be moved in pitch along the spinning spindles. The bobbin 3 is intermittently moved in response to a bobbin requesting instruction on the winder 2 side, and the bobbin 3 integrally mounted on the tray 4 is carried in a direction indicated at arrow toward the winder 2. A yarn on the bobbin 3 is rewound by the winder 2 on a yarn package having a predetermined shape and an amount of yarn, and a full package 5 is doffed from the winder 2 and then supplied to an inspection station 10 by a pakcage carrying system 6 including an overhead conveyor 7, a loading device 8 and an unloading device 9.

In the inspection station 10 for packages, the state of surface of a yarn layer of the package is checked visually by an operator and by an optical inspection apparatus. Unacceptable packages are removed from the carrying line, and acceptable packages are sorted by kind and stocked in a stocker. Thereafter, thus sorted individual packages are subjected to packing via steps of labelling by means for applying a visible display, automatic plastic film packing, and automatic packing in a case and then stored in a warehouse 19.

Spinning Winder

First, a section of the spinning winder will be described with reference to FIG. 2.

(1) General

Figure 2:
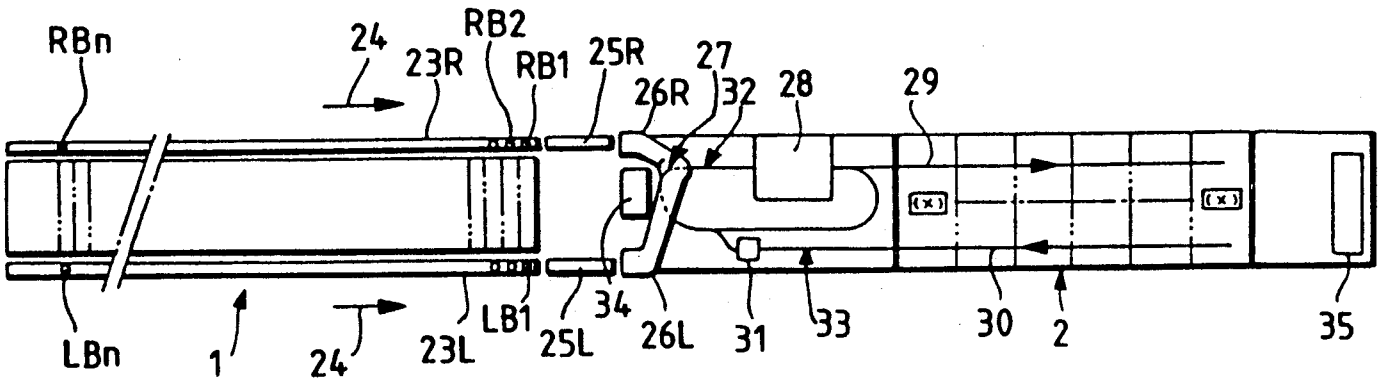
FIG. 2 is a plan view showing the structure of a spinning winder.

In FIG. 2, spinning bobbins produced in the spinning frame 1 are simultaneously doffed and stood upright on pegs provided at intervals of spinning spindle pitch on left and right transport bands 23L and 23R which can be moved in pitch along the spinning spindles. Thereafter, the transport band 23R or 23L is intermittently moved in a direction indicated at arrow 24 in response to a bobbin requesting instruction on the winder 2 side so that a bobbin is transported through an inclined connecting conveyor 25R or 25L and falls into a chute 26R or 26L from the upper ends of the conveyors 25R and 25L. The bobbin is mounted on the tray 4 which is on standby in a bobbin supply device 27.

A tray integral with the bobbin is supplied to a yarn end preparation device 28, where the yarn end is subjected to yarn end finding in the state suitable for piecing at the winder, and it is carried in a direction indicated at arrow toward the winder 2 on a carrying path 29.

In the winder, the bobbin mounted on the tray is supplied to each winding unit, where it is rewound and discharged. An empty bobbin discharged from each winding unit to a carrying path 30 is transported along with the tray to a bobbin removing station 31. In the station 31, an empty bobbin and a bobbin, which has a remaining yarn but an extremely small amount of remaining yarn which cannot be resupplied to the winder is removed from the tray with said bobbin stood upright, and the empty bobbin is returned to a predetermined position on the spinning frame 1 side via the empty bobbin carrying path not shown and the bobbin with an extremely small amount of yarn is separately discharged or stored into a box. Accordingly, trays having passed through the bobbin removing station are only those having a bobbin with a remaining yarn which cannot be resupplied to an empty tray or a winder.

Every time when an empty tray arrives at the spinning bobbin supply device 27, the transport band 23R or 23L on the side of the spinning frame is rotated pitch by pitch so that a single spinning bobbin is supplied to and stood upright on an empty tray which is on standby and again supplied to the winding unit.

(2) Carrying Tray

An operator is sometimes at a loss to grasp the state where between the spinning frame and the winder occurs a phenomenon that yarn breakages often occur in the rewinding step because yarns produced in one spinning frame unit are inferior to those produced in the other unit between the spinning frame and the winder, and even such a phenomenon, many piecing portions are present in the package wound on the winder side. That is, the yarns produced in the aforesaid specific spinning unit are free to be rewound by any winding unit in the winder. Accordingly, bobbins doffed from a spinning unit which produces yarns of poor quality for some cause and bobbins doffed from the other normal spinning unit are supplied in a random state to the winder, and therefore, yarns of poor quality are sometimes mixed into many packages to be doffed in the winder.

It is therefore necessary to provide carrying trays which can pursue a carrying route of yarns produced in the spinning unit, grasp the spinning unit as a production origin of bobbins from which yarn breakages abnormally often occur during rewinding in the winder and feeds back information of yarn breakages in the winder to control the spinning units of the spinning frame.

To this end, a discrimination display member (recording medium) capable of writing and erasing discrimination information of bobbins is mounted on the bobbin carrying tray for individually independently supporting and carrying spinning bobbins.

Figure 3:
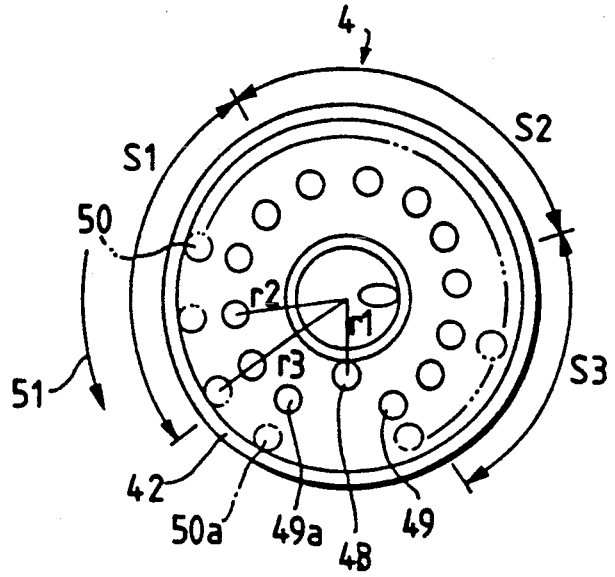
FIG. 3 is a plan view showing a tray for a spinning bobbin.
Figure 4:
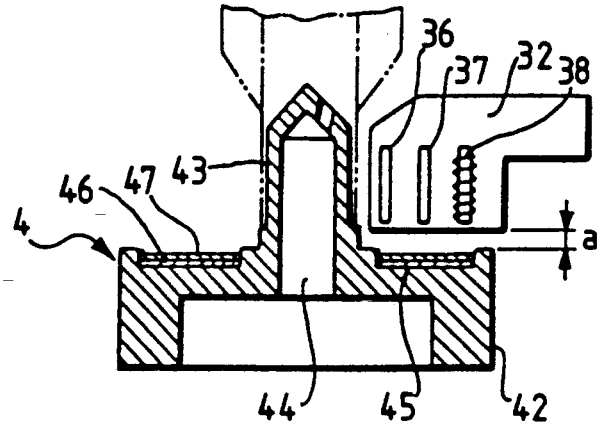
FIG. 4 is a schematic structural view showing one example of a write head.

That is, a tray 4 shown in FIGS. 3 and 4 has a disc-like base 42 formed thereon with pegs 43 for bobbins to be stood upright thereon, which are integrally molded from a non-conductive member such as a synthetic resin. The tray 4 is interiorly formed with air holes 44 but may be of solid.

The disc-like base 42 of the tray 4 is formed on the upper surface thereof with an annular groove 45, in which an iron plate for strengthening magnetism is fixed, and in addition, a recording medium formed from a rubber magnet sheet 47 is secured to the iron plate 46. The rubber magnet sheet 47 contains ferrite powder so that when a magnet is caused to draw near, magnetization is suitably attained.

In FIG. 3, a portion 48 magnetized as an information write or read start signal is formed at a part on the circumference of radius r of the tray, and equi-pitch portions 49*a* to 49*m* magnetized as a clock signal showing an information write or read position are preformed on the circumference of the radius r2.

In addition, a magnetizable portion 50 on which discrimination information of a spinning bobbin is formed on the circumference on the radius r3. In the FIGS. 2 and 3 embodiments, the discrimination information write portion consists of four sections. Information showing R side and L side of the spinning frame described later is written in a portion 50*a* corresponding to a equi-pitch portion 49*a*, and "frame numbers and spindle numbers" of the spinning frame of produced bobbins stood upright on the trays are written into other three sections S1, S2 and S3.

Figure 5:
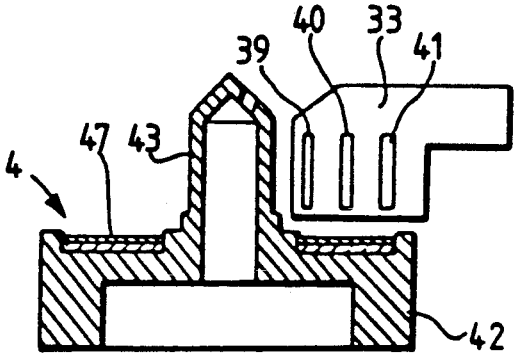
FIG. 5 is a schematic structural view showing one example of a read head.

As a write head (write device) 32, two magnetic sensors 36 and 37 and a writing electromagnet 38 are provided in a radial direction of the tray as shown in FIG. 4, and as a read head (read device) 33, three magnetic sensors 39, 40 and 41 are arranged in a radial direction of the tray as shown in FIG. 5. These heads 32 and 33 are movably or fixedly mounted in a spaced relation by a dimension a from the surface of a rubber magnet 47 on the upper surface of the tray at the write position and read position of the tray. The aforesaid dimension a is suitably of approximately 1.5 mm. That is, the magnetic sensors 36 and 39 reads the start signal 8 on the tray; the magnetic sensors 37 and 40 read clock signals 49*a* to 49*m*; and the magnetic sensor 41 reads discrimination signal of the bobbin.

(3) Control of Frame Numbers and Spindle Numbers

Next, the pursuit of bobbins will be described to which is applied the tray 4 shown in FIGS. 3 and 4 in the spinning winder shown in FIG. 2. In case of applying the aforesaid tray 4, a write head 32 for writing discrimination information of a spinning bobbin stood upright on the tray is provided on an in-side carrying path 29 of the winder, and a read head 33 for reading said information is provided on an out-side carrying path 30 of the winder. Operating instructions for the heads 32 and 33 is issued by a controller 34. On the winder side is provided a constant-length device 35 as a control device with a computer housed therein which inputs and processes various information from the winding unit and information from the read head 33.

Moreover, in the winder 2, yarn breakages are detected by an yarn breakage detection feeler provided on each winding unit and inputted into the constant length device 35, to which the number of yarn breakages of bobbins during rewinding in each unit is added for storage. The winding unit is provided with a lamp which flickers in response to a signal from the constant-length device 35 when the number of piecings during winding of a bobbin exceeds a set number.

In FIG. 2, the spinning frame 1 is applied with a discrimination signal for specifying the spindles with respect to all the spinning frame.

Assume now that in doffing in the spinning frame, that is, when a full bobbin is replaced by an empty bobbin, spinning bobbins RB1, RB2, . . . RBn are placed on the transport band 23R in front of the spinning frame, and spinning bobbins RB1, RB2, . . . RBn are placed on the transport band 23L on the other side.

In the above-described state, when a bobbin requesting signal is provided from the bobbin supply station 27 on the winder side to the spinning side, it is supplied to an empty tray on standby successively from a bobbin RB1 in the forefront of the R-side transport band 23R. At that time, every time when a bobbin is supplied from the spinning frame, spindle numbers RB1 to RBn supplied to the tray and frame numbers of the spinning frames are written by the write device 32. That is, in the write position, the tray 4 is rotated at constant speed in a direction as indicated at arrow 51. If, for example, R-side out of R and L is magnetized, in case of the bobbin RB1, an R/L discrimination portion 50*a* of FIG. 3 is magnetized, and a discrimination symbol corresponding to the first spindle is magnetized in a portion of the section S1. For example, in case of No. 3 frame and the 001 spindle, "03001" is provided as shown in FIG. 6.

Figure 6:
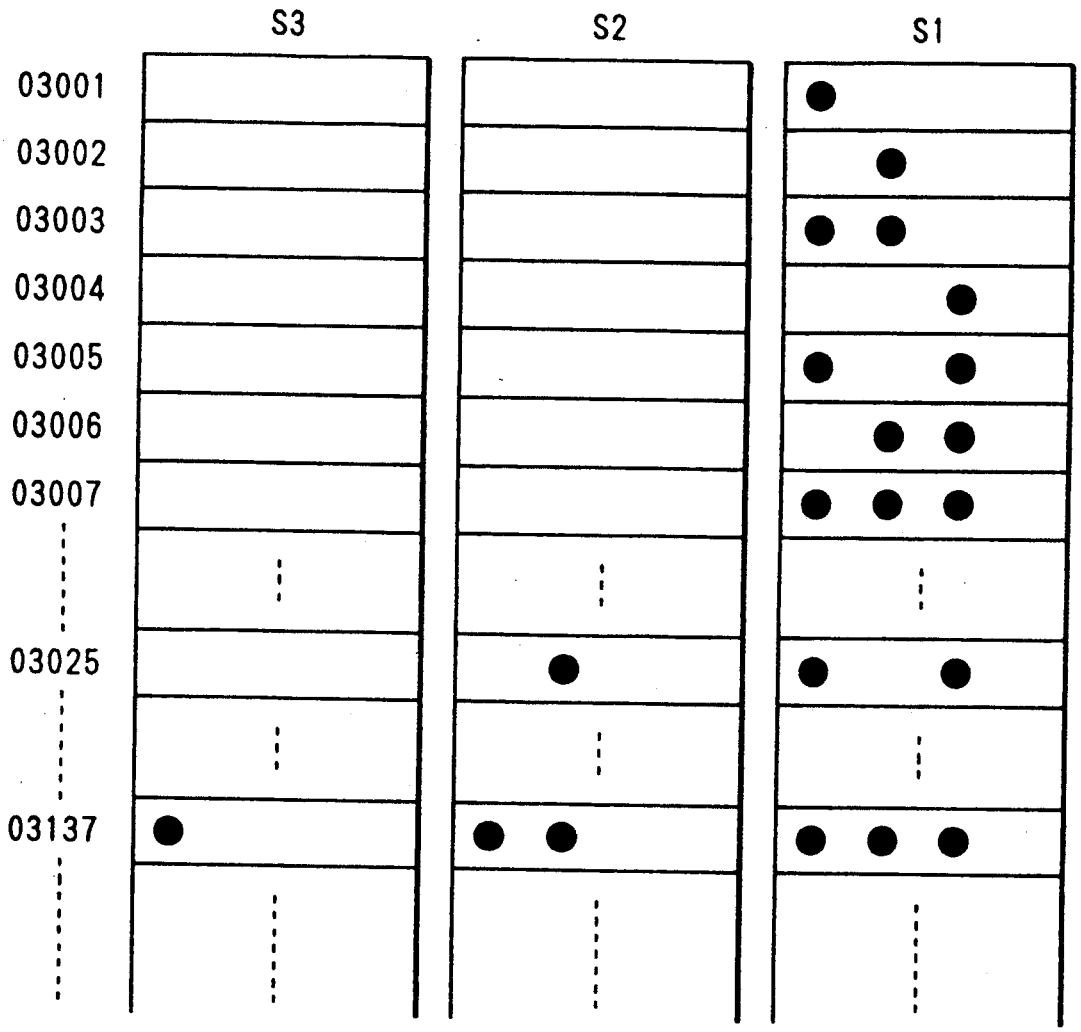
FIG. 6 is an explanatory view showing the relationship between the magnetizing state of a rubber magnet sheet and a spinning spindle.

Subsequently, when the transport band is moved by one pitch so that a bobbin in the second spinning frame is supplied onto the tray 4, a magnetized state "03002" corresponding to the spindle number 2 is written on the tray as shown in FIG. 6. In this way, the spindle number plus 1 every time when a bobbin is supplied is coded and written into the tray.

The spinning bobbin 3 with the frame number and spindle number written and supported on the tray is transported in a direction as indicated at arrow on the carrying path 29 via the yarn end preparation device 28 shown in FIG. 2 and supplied to the winding unit. It is to be noted that as a winder for supplying a bobbin while being mounted on the tray to a rewinding position, for example, a winder disclosed in Japanese Patent Laid-open Publication No. 57(1982)-170354 can be applied.

When one bobbin is supplied to the rewinding position and rewinding operation is started, the number of knottings is added in the constant-length device 35 so that the number of knottings per unit time (minute) of the bobbin exceeds a predetermined value. In this case, judgement is made that too many defects of yarns involve in the spinning bobbin, and as the result, a discontinuation instruction of winding is outputted to the unit and the lamp of the unit is made to flicker to inform an operator thereof.

The operator removes from the tray a bobbin in the midst of rewinding at the rewinding position of the winding unit and again starts the winding operation. Then, an empty tray is removed from the unit and moved onto the carrying path 30 and carried in a direction as indicated at arrow in FIG. 2.

When an empty tray without a bobbin arrives at the position of the read head 33, discrimination information on the empty tray is read to read the spindle number, as shown in FIG. 5, and transferred to the constant-length device 35. The transferred data is summed up by the constant length device 35 or a computer which controls the device 35 whereby defective numbers of the spinning frame and frame numbers belonging thereto can be known.

Of course, even in the read head position, the tray is rotated once to read similarly to the write position. However, the tray and the write or read head may be relatively rotated. The head can be rotated once while the position of the tray is fixed.

An empty tray having passed through the read device 33 is transferred to the bobbin supply position 27, and a new spinning bobbin is again received. A frame number and spindle number of a spinning frame which produced said bobbin are newly written while the frame number and spindle number previously written are erased.

The constant length device 35 collects and controls quality information as follows: (1) operating efficiency, (2) length of winding yarn, (3) the number of times of piecings, (4) the number of times of successes of piecing, (5) the number of times of projections of a yellow button which projects in the event that piecing is unsuccessful continuous plural times, (6) the number of times of occurrence of BQC (Bobbin Quality Check) for monitoring abnormally frequent occurrence of end breakages per bobbin, (7) clearer cut produced in cases of a defect in which coarseness of yarn is abnormally large and thin, a defect in which coarseness of yarn is abnormally large and long or a defect in which coarseness of yarn is abnormally thin and long, and (8) collection of unacceptable spindle numbers and frame numbers belonging thereto of the spinning frame.

In addition, in case of the computer for controlling the constant length devices 5, there can be mentioned, in addition to the concentrated monitoring of the (1) to (8) of the constant length device 35, (1) analysis of cause of occurrence of end breakages, (2) analysis of cause of occurrence of the yellow button, and (3) analysis of main cause of the lowering of operating efficiency, and collection of measured data of a splicer checker (a device for automatically measuring yarn strength of a piecing portion).

While in the aforementioned embodiment, a description has been made of a control system for a spinning frame in which a spinning spindle number if written on a rubber magnet sheet secured to a tray, it is to be noted that information for discriminating kinds of bobbins mounted on the rubber magnet sheet can also be written.

As explained above in connection with FIGS. 3 to 6, a discrimination information display member capable of being written and erased is provided on the bobbin carrying tray 4. If discrimination information of a bobbin to be mounted is written therein, the bobbin itself transfers the discrimination information along with the bobbin, and therefore, the pursuit and adjustment of the bobbin can be simply carried out as compared with the case where a discrimination mark peculiar to a tray is applied to the tray.

Package Carrying System

(1) General

Figure 7:
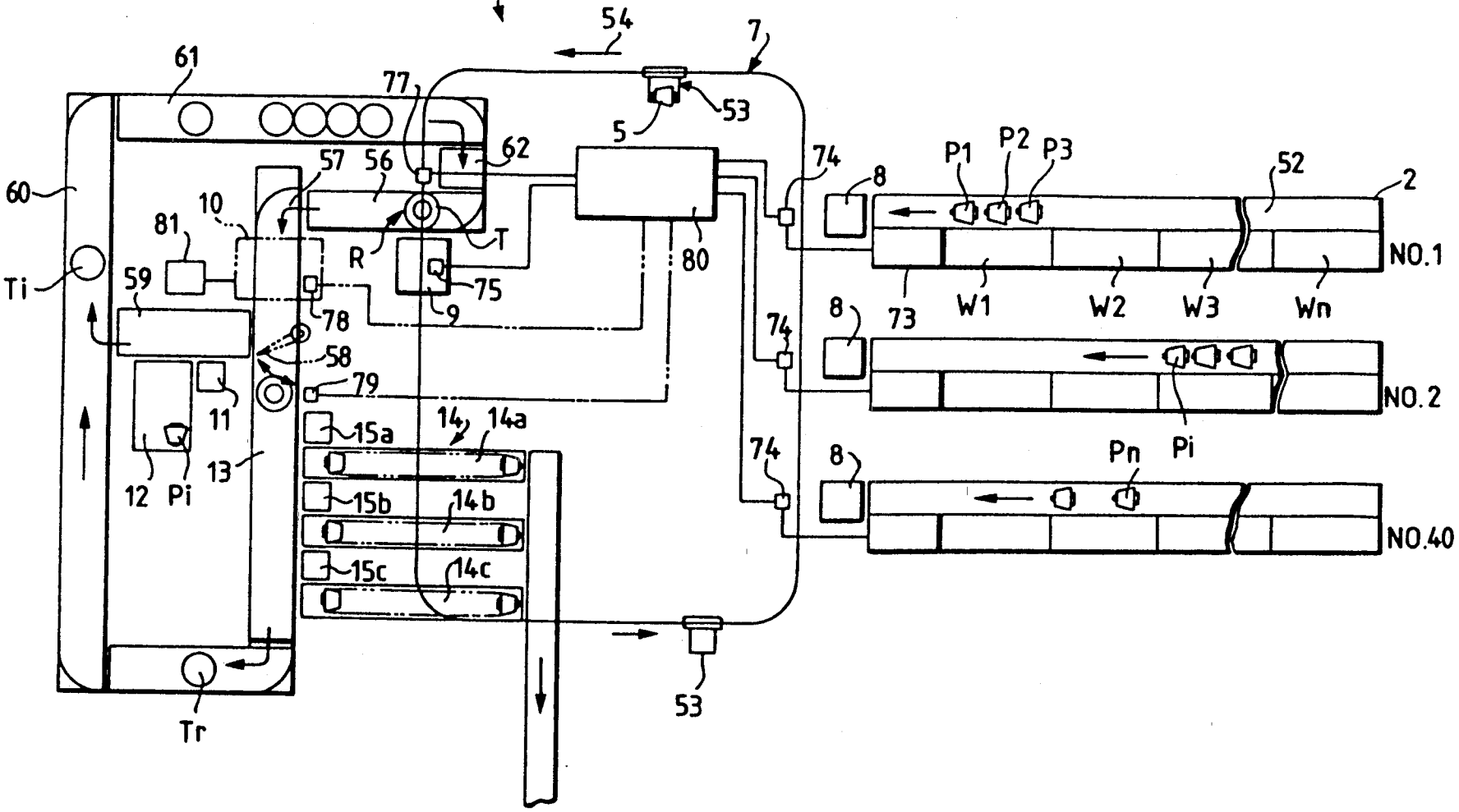
FIG. 7 is a view showing the structure of a package carrying system.

FIG. 7 shows a layout of a package carrying system.

Full packages 5 (P1 to Pn) produced by winders 2 in quantity of 40 in total of the aforementioned spinning winder are subjected to doffing by an automatic doffer not shown and carried to ends of frames without changing the order by carrying conveyors 52 each laid along winding units W1, W2, . . . Wn per frame. The packages are moved upward one by one by a loading device 8 (FIG. 8) provided at the end of the frame and delivered to a package hanger 53 of the overhead conveyor 7 which circulates and runs overhead.

Figure 10:
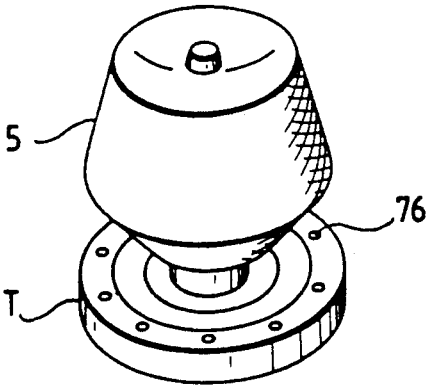
FIG. 10 is a perspective view showing a package and a package tray.

The package 5 carried by rotation of the overhead conveyor 7 in a direction as indicated at arrow 54 is transferred to and mounted, as shown in FIG. 10, on a package carrying tray (package tray) T which is on standby on the lower conveyor 56 at the position of the unloading device 9. The package along with the tray T is carried in a direction as indicated at arrow 57 and supplied to the package inspection station 10.

Out of packages already subjected to inspection in accordance with predetermined checking items in the package inspection station 10, acceptable packages and unacceptable packages are sorted. Unacceptable packages are fed, for example, into a branch path 59 by a movable guide 58, and a package Pi removed from the tray by the package removing device 11 is received into a box 12.

On the other hand, packages determined to be acceptable are delivered out of the inspection station 10 and transferred to the conveyor 13, where the packages are separated from a tray Tr by removing devices 15*a* to 15*c* and thence stocked in package stock lines 14*a* to 14*c* which constitute a stocker 14. The empty trays Tr and Ti with packages removed therefrom are again carried to the package receiving position R by conveyors 60, 61, 62, etc to ready for receiving packages.

(2) Package Hanger

Figure 8:
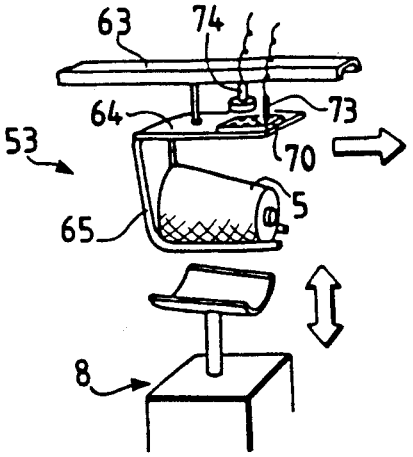
FIG. 8 is a view showing the structure of a package hanger.

As shown in FIG. 8, a package hanger 53 suspended by a support 64 on a chain which runs along a track 63 is provided a package place arm 65 secured to the lower surface of the support 64 to thereby receive the package 5 from the loading device 8 or deliver it to the unloading device 9.

On the upper surface of the support 64 is provided a recording medium carrier 70 in which an ironsheet and a rubber magnet sheet (recording medium) are laminated on a base formed of a non-magnetic material. Two rows of a plurality of dot-like magnetizing regions are provided on the recording medium carrier 70 in a moving direction of the hanger 53. Magnetizing regions 71 on the first row are pre-magnetized for timing whereas magnetizing regions 72 on the second row are provided to record frame numbers and spindle numbers which are package production original information.

Figure 9:
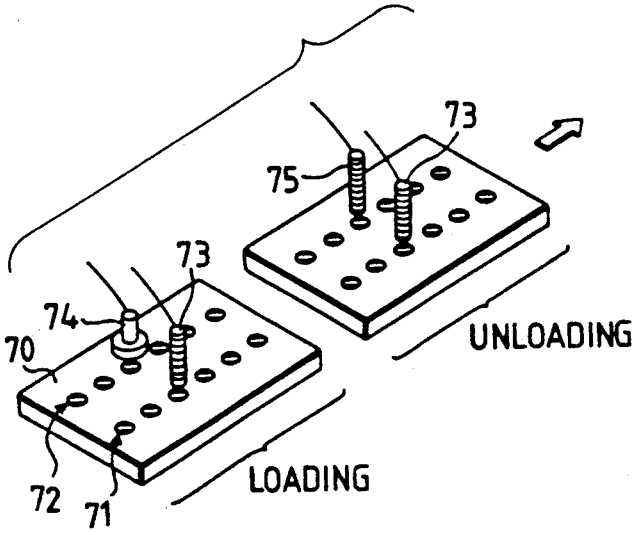
FIG. 9 is a view showing the structure of a write head and a read head with respect to the hanger.
Figure 11:
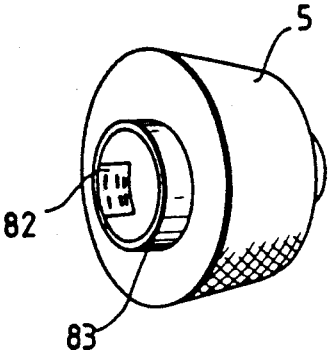
FIG. 11 is a perspective view showing the state where a label is attached to a package.
Figure 12:
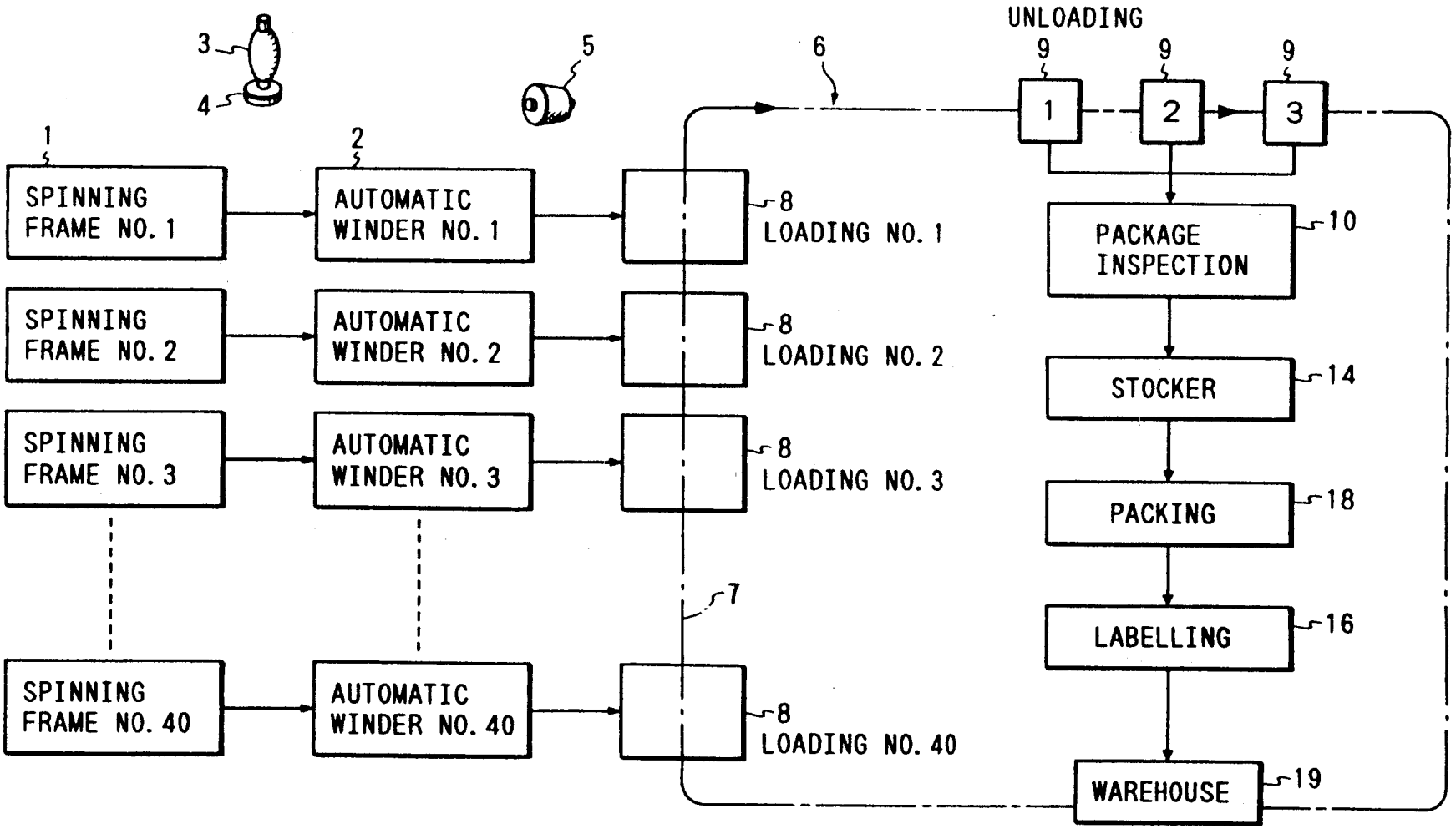
FIG. 12 PRIOR ART
FIG. 12 is a schematic view of a conventional quality and production control system.

On the other hand, as shown in FIG. 9, corresponding magnetic heads are provided on the side of the track 63. At the position of the loading device 8 is provided a write head (write device) 74 for writing frame numbers and spindle numbers on the magnetizing regions, and at the position of the unloading device is provided a read head (read device) 75 for reading the frame numbers and spindle numbers written on the magnetizing regions 72. Reference numeral 73 designates a timing sensor for detecting an arrival of a hanger at a predetermined position from the timing magnetizing region 71 to generate a write timing signal or a read timing signal.

(3) Package Carrying Tray

As shown in FIG. 10, a package carrying tray T has a plurality of magnetizing regions 76 along the circumferential direction of the upper surface thereof. The magnetizing region 76 is formed from a magnetic recording medium similar to the case of the carrying tray 4 for the spinning bobbin 3 already described above.

In FIG. 7, in the unloading device 9 is provided a write device 77 for writing package production origin information on the magnetizing region 76 of the package carrying tray T, and in the inspection station 10 is provided a read device 78 for reading package production origin information written.

(4) Control of Frame Numbers and Spindle Numbers (a) Loading and Unloading in the Winder When in the first frame, a stock bar extending over all units W1, W2, . . . Wn of the winder is actuated, a plurality of packages 5 (P1 to P3) being stocked in said frame are simultaneously delivered onto the conveyor 52. At that time, by which unit the packages doffed till previous actuation of the stock bar are wound (to which spindle the packages belong) are inputted into a memory of the constant length device 35 of said frame and respectively stored.

The actuation of the stock bar is successively carried out, for example, at intervals of 10 minutes, every frame. For the frames after the first one, to which spindle the packages belong are likewise stored.

Since the above-described packages are carried by the conveyor 52 to the ends of the frame without changing the order, the units which have carried out the doffing out of the winding units W1, W2, . . . Wn can be made in correspondence to the packages being carried in the loading device 8. In the case of the illustrated first frame, the package P1 produced in the unit W1 is first delivered to the package hanger 53 of the overhead conveyor 7, and the package P2 of the unit W2 and thence the package P3 of the unit W2 are respectively delivered thereto.

A central control device 80 specifies the spindle number of the package 5 to be loaded by the discrimination number of the unit stored in the constant length device 35, that is, the spindle number, and the order doffed as described above, that is, the order to be carried. The central control device 80 further grasps from which constant length device out of 40 frames the spindle number is obtained, for example, from the actuating order of the stock bar to thereby specify the frame number. The central control device 80 instructs the write head 74 to write the corresponding frame number and spindle number on the magnetizing regions 72 of the recording medium carrier 70 provided on the hanger 53 of the overhead conveyor 7 every time when the package 5 is transferred to the upper hanger 53.

In this manner, the full packages delivered by the winders W1 to Wn are successively transferred to the hanger 53 of the overhead conveyor 7, and the packages 5 are carried along with the production frame number and spindle number.

The package carried by the overhead conveyor 7 to the unloading device 9 is transferred to the tray T on the conveyor belt 56 leading to the inspection station 10 from the hanger 53. At that time, the discrimination symbols, that is, the frame number and spindle number, which are recorded on the hanger with the package to be unloaded placed, are read by the read device 75, and the production origin information of the package is written on the recording medium ((76) in FIG. 10) on the tray T on which the package is mounted, in accordance with the instructions from the central control device 80, and the transfer of the production origin information is carried out by the write device 77.

(b) Automatic Package Inspection—Stocker

In the inspection station 10, winding shapes (such as presence or absence of twill, wrinkles, tail or the like), weight, mixture of different kinds, etc. of the package carried together with the tray is checked by a well-known CCD camera or the like. Unacceptable packages determined to be unacceptable as the result of inspection in the foresaid station are read by the production origin information recorded in the tray by the read device 78 whereby the frame number and spindle number of the automatic winder by which the packages were wound can be known. According to the inspection results in the station 10, data is processed by the processing device 81, whereby inspection results of various packages are listed so that the package production origins at which defective packages often occur can be known easily. The unacceptable package Pi is removed from the tray by the package removing device 11 and received into the box 12.

On the other hand, packages determined to be acceptable are delivered out of the inspection station 10 and are transferred to the conveyor 13, during which they are removed from the trays by the removing devices 15*a* to 15*c* and stocked by brands A, B and C in the package stock lines 14*a* to 14*c*. At this time, trays for packages are read by the read device 79, and the frame numbers and spindle numbers are recorded in order of those entered the package stock lines 14*a* to 14*c*. Removal of packages from the stock lines 14*a* to 14*c* is effected by designating the brands.

(c) Automatic Labelling

Packages removed from the stock lines 14*a* to 14*c* are sent to the automatic labelling 16 as a visible display means, and a label 82 with necessary items such as a frame number, a spindle number, date, brand, etc printed is attached to the inner surface of the take-up tube 83 of the package 5. An operator can see the frame number and spindle number printed on the label 82 to discriminate the production origin.

(d) Automatic Plastic Film Packing—Automatic Packing in a Case

The number of packages packed in a case is predetermined. So, if in which case packages are put is determined at the time when the packages are moved out of the stocker 14, the operator may know which package is in a case. Necessary items such as date, brand, lot number, destination, etc. are printed on the outer surface of the case.

As described above, the following records of the package within the case are clarified.

(i) Detailed information such as the frame number of the spinning frame, spindle number, and date of production.

(ii) Detailed information such as the frame number of the automatic winder, spindle number, and date of production.

(iii) Detailed information of automatic package inspection.

As described above, according to the present invention, in the steps from the spinning frame to the warehouse, a flow of products and a flow of information by spindle of the spinning frame or the winder are synchronized and visibly displayed, and therefore, the production origin information can be controlled and the records can be grasped. Furthermore, even if a product of inferior quality is discovered, the cause can be cleared up backing to the steps, frames and spindles, and measures can be taken.

Next, a package carrying apparatus for transferring full packages doffed from units to a lifting device, which is aware of a spindle by which a wound package is prepared, will be described referring to FIGS. 13 to 15.

An embodiment of the package carrying apparatus is the apparatus in which a stock line for stocking full packages doffed from units is provided at the rear of a multi-spindle winding unit, and a carrying conveyor is provided at the rear of said stock line through a shutter so that the doffed full packages are carried from the stock line to a package lifting device through the carrying conveyor, said package carrying apparatus comprising a constant-length control device for storing spindle numbers of full packages doffed in the stock line and rearranging the doffed spindle numbers when the shutter is opened to store the spindle numbers in order of carrying received by the package lifting device, and a package lifting control device for successively receiving the full packages on the carrying conveyor and storing the spindle numbers in order of carrying from said constant-length control device.

According to the aforementioned arrangement, normally, full packages are first discharged from each winding unit at random to the stock line. However, when the packages are discharged to the conveyor, the packages are lined up on the conveyor in order of arrangement of spindles irrespective of the order of doffing. Packages carried to the package lifting device are received in order of those on spindles near the lifting device. So, the constant-length control device rearranges spindle numbers of packages on the stock line in order of carrying when the shutter is opened, and the spindle numbers in order of carrying of the packages are transmitted to the package lifting device when the packages are carried from the conveyer to the package lifting device whereby the lifting device is aware of the spindles by which packages are prepared.

Figure 13:
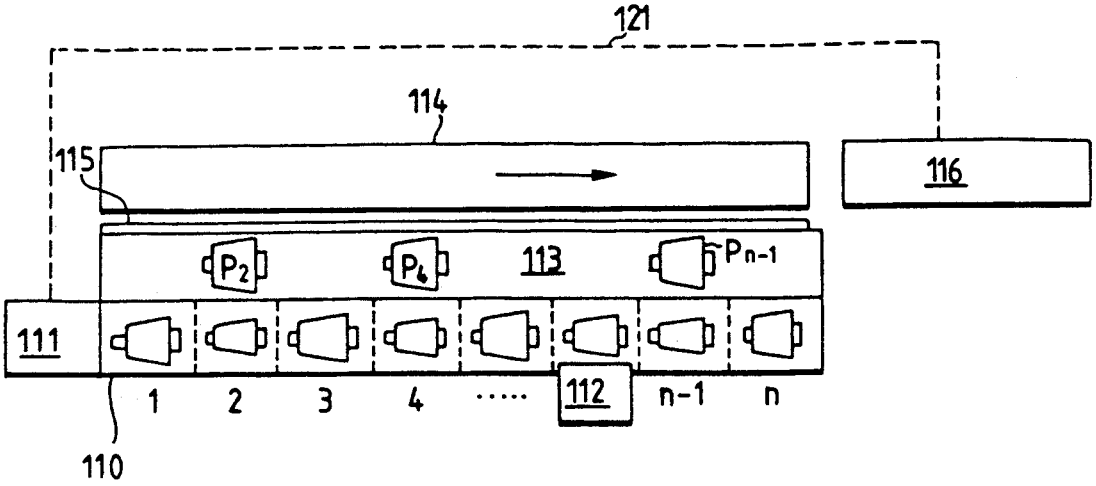
FIG. 13 is the whole plan view showing one embodiment of a package carrying apparatus of the present invention.

First, FIG. 13 is a plan view of an automatic winder according to the embodiment of the present invention. In FIG. 13, winding units $\mathbf{110}_{1-n}$ are provided lined up in a multi-spindle manner, and on one side thereof is provided a constant-length control device 111 for controlling a winding length at each winding unit 110. There is provided a doffer 112 which can be reciprocatingly moved along the front surface of the multi-spindle winding units $\mathbf{110}_{1-n}$. A stock line 113 is provided at the rear of the winding units $\mathbf{110}_{1-n}$, and a carrying conveyor 114 is provided parallel with the stock line 113. A shutter 115 is provided between the stock line 113 and the conveyor 114. A package lifting device 116 for packaging packages or delivering them to the post step is provided at the delivery end of the carrying conveyor 114.

Figure 14:
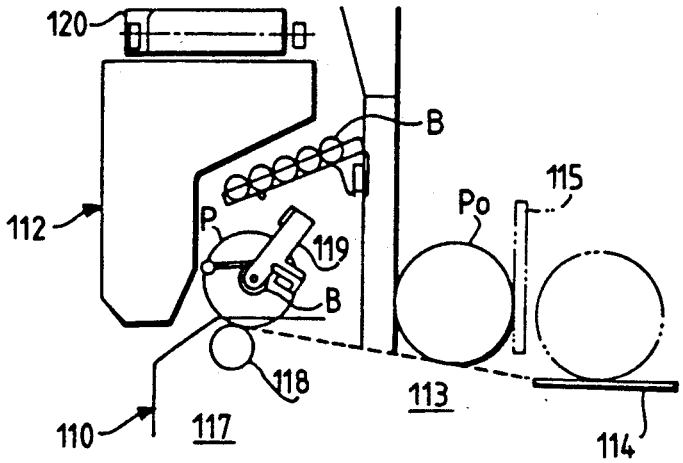
FIG. 14 is a view showing the relationship between the winding unit and the doffer in the embodiment.
Figure 15:
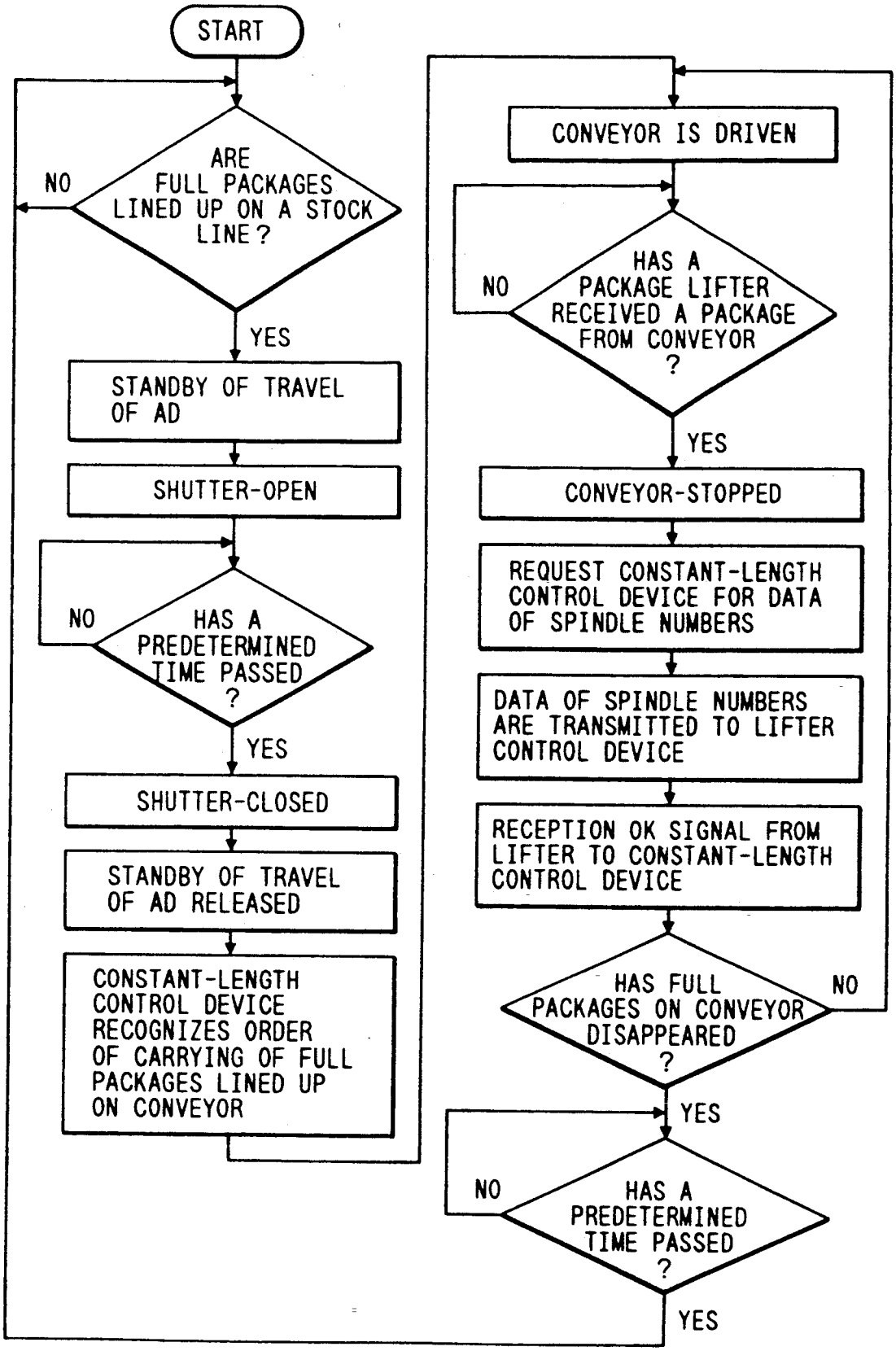
FIG. 15 is a flow chart of the constant-length control device and the lifting device according to the embodiment.

As shown in FIG. 14, in the winding unit 110, a drive drum 118 is provided on a unit body 117 so that a winding package P is rotated on the drive drum 118 to wind a yarn on a spinning bobbin (not shown). A paper tube B of the winding package P is rotatably supported on a cradle arm 119 so that the former is rotated in contact with the drum 18.

The constant-length control device 111 receives a rotation signal of the drum 118 of each winding unit 110 to detect whether the winding package P is full or not from the speed thereof, and when a full package is reached, rotation of the drum 118 is stopped. The constant-length control device 111 receives knotting information when the knotting is carried out in the winding unit 110 due to replacement of a spinning bobbin, end breakages, defective yarns, etc.

The doffer 112 is suspended so that it may travel along the rail 120 provided above the winding units 110. The doffer 112 reciprocatingly moves between the units to detect a full package Po, at which the doffer stops to doff the full package Po. That is, the doffer 112 disengages the full package Po from the cradle arm 119, cuts a yarn, rolls the full package Po to a position of the stock line 113, mounts the paper tube B stocked above the winding unit 110 to the cradle arm 119, and engages the cut yarn with the paper tube B, and thereafter drive the drum 118. The full package Po on the stock line 113 is stopped at the closed shutter 115, and when the shutter 115 is opened, the package is delivered to the carrying conveyor 114. When a predetermined number of the packages Po stocked on the stock line 113 is reached, the constant-length control device 111 outputs an opening instruction to a shutter open- and closing device (not shown) so as to open the shutter 115.

When the shutter 115 is opened, the constant-length control device 111 rearranges spindle numbers of packages P lined up on the stock line 113 in order of carrying in order of doffing to output it to a control device (not shown) of the package lifting device 116 through a transmit-receive line 121. This will be described with reference to FIG. 13. The winding package $P_4$ of a fourth spindle is first doffed, the package $P_2$ of a second spindle is then doffed, and the package $P_{n-1}$ of the $n-1$ spindle is finally doffed to reach given numbers. Then, the constant-length control device 111 rearranges the spindle numbers in order of doffing in order of carrying. The spindle numbers are rearranged in order of those near the package lifting device, that is in order of those having a large number ($n-1, \ldots 4, 2$), after which the doffer 112 is instructed for standby to open the shutter 115. When the shutter 115 is opened, the packages P are aligned in order of carrying on the conveyor 114. Next, the conveyor 114 is driven to successively carry the packages P to the package lifting device 116. The control device of the package lifting device 116 which has received the package P request the constant-length control device 111 for data of spindle number of that package through the receive -and transmit line 121, receives data of the spindle number of that package from the constant-length control device 111, and thereafter receives data of spindle number whenever receiving the package P. Upon receipt of data of the spindle number, the lifting device 116 effect labelling data on the package on the basis of said data.

In this labelling, winding information received by the lifting device 116 is printed directly on the full package Po, for example, or winding information is printed on a label to paste it on the full package Po.

Next, a flow chart of the constant-length control device 111 and the control device of the package lifting device 116 will be described in detail with reference to FIG. 15.

When control is started, judgement is made if a predetermined number of full packages are lined up on the stock line. If so (yes), the doffer is placed in a standby state. With this standby of the doffer, it is possible to prevent a new package from being doffed on the stock line. Next, the shutter is opened, judgement is made if a predetermined time (a few seconds) required for a package to be positively moved from the stock line to the conveyor has passed, and thereafter the shutter is closed, and the travel of the doffer is released. Next, after the order of carrying packages transferred to the conveyor has been recognized, the conveyor is driven. When the conveyor is driven, a package near the lifting device is received. Upon receipt of the package, the conveyor is stopped. The control device of the package lifting device 116 requests the constant-length control device 111 for the spindle number of that package, so that the constant-length control device transmits the spindle number to the control device of the package lifting device 116. Upon receipt of the spindle number, a signal of such receipt is outputted to the constant-length control device 111. Next, the constant-length control device 111 judges if any packages remain on the conveyor. If so, the conveyor is again drived as described above so that spindle numbers of packages successively carried are received and at the same time such operation is repeated till the packages disappear from the conveyor. If the packages disappear, the control is returned to its original state after passage of a predetermined time (one minute).

The lifting device 116 receives the spindle data of the constant-length control device 111 in order of carrying of packages as described above, whereby spindles by which packages are prepared can be controlled.

As will be apparent from the foregoing explanation, this embodiment of the present invention has the following excellent effect.

The constant-length control device rearranges spindle numbers of packages on the stock line in order of carrying and transmits the spindle numbers in order of carrying of the packages to the package lifting device when the packages are carried from the conveyor to the package lifting device. Thereby, the spindles by which packages are prepared can be controlled.

What is claimed is:

1. In a spinning mill in which a bobbin from a spinning frame is mounted on a bobbin tray and sent to a winder, a package doffed from the winder is loaded on a hanger and carried, after which it is unloaded and then mounted on a package tray, which is supplied to an inspection station, a production control system comprising:

recording media provided on the bobbin tray, the hanger and the package tray, write means for recording information on the hanger at the time of loading, the information including spinning frame numbers, spinning spindle numbers, winding frame numbers and winding spindle numbers, read/write means for transferring the information recorded by the write means to the package tray at the time of unloading, read means for reading the information transferred to the package tray, and display means for applying a visible display of the transferred information to the package.

2. The system as claimed in claim 1, wherein the bobbin tray is integrally molded from a non-conductive member and has a disc-like base formed thereon with pegs for bobbins to be stood upright thereon, on the upper surface of the disc-like base, an annular groove being formed and an iron plate and a rubber magnet sheet being fixed in the annular groove as the recording media.

3. The system as claimed in claim 2, wherein the read/write means comprises a write device comprising magnetic sensors and a writing electromagnet provided in a radial direction of the tray, and a read device comprising a plurality of magnetic sensors arranged in a radial direction of the tray.

4. The system as claimed in claim 3, wherein a constant length device comprises a control device with a computer housed therein which inputs and processes information from winding units and information from the read device provided with each winder.

5. The system as claimed in claim 4, wherein the hanger includes a package place arm secured to the lower surface of a support to thereby receive a package, and a recording medium carrier in which an iron sheet and a rubber magnet sheet are laminated on a base formed of a non-magnetic material.

6. The system as claimed in claim 1, wherein the package tray has a plurality of magnetizing regions along the circumferential direction of the upper face thereof.

7. The system as claimed in claim 1, wherein the display means for applying a visible display comprises an automatic labelling device which attaches a label to the inner surface of a take-up tube of the package.

8. A production control system for use in a spinning mill wherein a bobbin is mounted on a bobbin tray and sent to a winder, and a package doffed from the winder is carried by a hanger, unloaded, mounted on a package tray, and carried to an inspection station, the production control system comprising:

recording means associated with the bobbin tray, the hanger and the package tray for recording data, the data including spinning frame numbers, spinning spindle numbers, winding frame numbers and winding spindle numbers;

read/write means for transferring the data from the bobbin tray to the winder, from the winder to the hanger, and from the hanger to the package tray; and read means for reading the data transferred to the package tray.

9. The system of claim 8, further comprising:

display means for applying a visible display of the transferred data to the package.

10. The system of claim 9, wherein the display means comprises a labelling device which attaches a label to the package.

11. The system of claim 8, wherein the read/write means comprises a write device comprising magnetic sensors and a writing electromagnet provided in a radial direction of the tray, and a read device comprising a plurality of magnetic sensors arranged in a radial direction of the tray.

12. A package handling apparatus for use with a multi-spindle winding unit having a stock-line for stocking full packages doffed from the spindles on one side of the multi-spindle winding unit, a carrying conveyor on a side of the stock line opposite the winding unit and a shutter between the stock line and the carrying conveyor, the package handling apparatus comprising:

a control device comprising first storage means for storing spindle numbers of the full packages in the stock line and rearranging the spindle numbers when the shutter is opened such that the spindle numbers are stored in the order the packages will be received by the package handling apparatus;

second storage means for storing spindle data, the spindle data including at least one of spinning bobbin replacement data, defective yarn data and breakage data; and package handling means for handling packages received from the carrying conveyor and storing the spindle numbers in the order the packages are received from the carrying conveyor, the package handling means including display means for applying a visible display of the spindle data to the package.

* * * * *